US007737769B2

(12) United States Patent
Deng et al.

(10) Patent No.: US 7,737,769 B2
(45) Date of Patent: Jun. 15, 2010

(54) OPAMP-LESS BANDGAP VOLTAGE REFERENCE WITH HIGH PSRR AND LOW VOLTAGE IN CMOS PROCESS

(75) Inventors: Yun Fei Deng, Shanghai (CN); Shun Bai Tang, Shenzhen (CN)

(73) Assignee: Shenzhen STS Microelectronics Co., Ltd., Shenzhen (CN)

( * ) Notice: Subject to any disclaimer, the term of this patent is extended or adjusted under 35 U.S.C. 154(b) by 0 days.

(21) Appl. No.: 12/049,127

(22) Filed: Mar. 14, 2008

(65) Prior Publication Data

US 2008/0224761 A1 Sep. 18, 2008

(30) Foreign Application Priority Data

Mar. 16, 2007 (CN) ..... 2007 1 0088615

(51) Int. Cl.
*G05F 1/10* (2006.01)

(52) U.S. Cl. ..... 327/541; 327/539; 327/543

(58) Field of Classification Search ..... 327/313, 327/538–543; 323/312, 313
See application file for complete search history.

(56) References Cited

U.S. PATENT DOCUMENTS 6,222,399 B1 * 4/2001 Imbornone et al. ..... 327/143
6,294,902 B1 * 9/2001 Moreland et al. ..... 323/268
6,815,941 B2 * 11/2004 Butler ..... 323/313
7,193,402 B2 * 3/2007 Lee et al. ..... 323/313
7,408,335 B1 * 8/2008 Wong et al. ..... 323/316
2009/0231770 A1 * 9/2009 Schuelke et al. ..... 361/92

* cited by examiner

*Primary Examiner*—Long Nguyen
*Assistant Examiner*—Sibin Chen
(74) *Attorney, Agent, or Firm*—Lisa K. Jorgenson; Andre M. Szuwalski

(57) ABSTRACT

A circuit includes an OPAMP-less bandgap voltage generating core circuit connected between a regulated voltage and a ground reference to generate an output bandgap voltage. A preregulator circuit generates the regulated voltage from an unregulated supply voltage. The preregulator circuit includes a negative feedback loop operable to stabilize the regulated voltage and a current source operable to source current for the regulated voltage, the current source mirroring a PTAT current of the OPAMP-less bandgap voltage generating core circuit. The core circuit further includes a negative feedback loop and a positive feedback loop, the negative and positive feedback loops functioning to equalize two internal voltages within the core.

20 Claims, 6 Drawing Sheets

OPAMP-LESS BANDGAP VOLTAGE REFERENCE WITH HIGH PSRR AND LOW VOLTAGE IN CMOS PROCESS

PRIORITY CLAIM

This application is a translation of and claims the benefit of Chinese Application for Patent No. 200710088615.4 of the same title, filed Mar. 16, 2007, the disclosure of which is hereby incorporated by reference.

BACKGROUND OF THE INVENTION

1. Technical Field of the Invention

The present invention relates generally to bandgap voltage reference generation circuitry realized in CMOS process. More particularly, the present invention relates to a bandgap voltage reference generator with high PSRR and low power dissipation suitable for use with a low voltage supply.

2. Description of Related Art

Reference in now made to FIG. 1 wherein there is shown a circuit diagram of a classical implementation of a bandgap voltage reference generator 10. The generator 10 includes an operational amplifier (OPAMP) 12 having a positive input 14, a negative input 16 and an output 18. A voltage divider is formed by two series connected resistors R1 and R2 which are coupled together at node Y, with node Y being connected to the negative input 16. A first end of the voltage divider is connected to the output 18 of the operational amplifier 12. A second end of the voltage divider is connected to the emitter of a bi-polar transistor Q2. The collector and base of the transistor Q2 are connected to a ground reference. A resistor R3 is coupled between the output 18 of the operational amplifier 12 and node X, with node X being connected to the positive input 14. Node X is further connected to the emitter of a bi-polar transistor Q1. The collector and base of the transistor Q1 are connected to a ground reference, such that the bases of the transistors Q1 and Q2 are connected together.

The OPAMP 12 is needed to make the voltage at nodes X and Y equal and stable. In addition to this, an improvement in PSRR with the OPAMP allows for its wide use in bandgap circuits. In a normal application, the OPAMP is just a basic differential input operational amplifier. However, to improve PSRR in low voltage applications, a high performance with high gain and high speed and low-offset OPAMP is desired. This results in a bandgap circuit that is more complex with a higher power dissipation. Such a circuit is not well suited for use in signal processing applications such as in a data converter.

Given the foregoing, there is an interest in the use of OPAMP-less bandgap generators. However, such circuits are typically not suitable for signal processing applications for a number of reasons.

Reference is now made to FIGS. 2 and 3 which illustrate, respectively, a simple and a cascode OPAMP-less bandgap voltage reference generator circuit known in the prior art.

In FIG. 2, bipolar transistors Q1 and Q2 are connected as in FIG. 1 with their collectors and bases coupled to the ground reference voltage. With respect to the emitter of transistor Q1, it is connected to a supply reference voltage Vdd through the series-connected source-drain circuits of MOS transistors M1 and M3 (where M1 is an n-channel device and M3 is a p-channel device). The gate of transistor M1 is connected to the drain of transistor M1. With respect to the emitter of transistor Q2, it is connected to the supply reference voltage Vdd through the series-connected source-drain circuits of MOS transistors M2 and M4 (where M2 is an n-channel device and M4 is a p-channel device) and series connected resistor R1. The resistor R1 is coupled between the emitter of transistor Q2 and the source of transistor M2. The gate of transistor M4 is connected to the drain of transistor M4. Additionally, the gate of transistor M4 is connected to the gate of transistor M3, while the gate of transistor M2 is connected to the gate of transistor M1. A third bipolar transistor Q3 is provided with its collector and base coupled to the ground reference voltage. With respect to the emitter of transistor Q3, it is connected to the supply reference voltage Vdd through the series-connected source-drain circuit of p-channel MOS transistor M5 and resistor R2. The resistor R2 is coupled between the emitter of transistor Q3 and the drain of transistor M5, with the bandgap output voltage Vbg being taken at the drain of transistor M5. The gate of transistor M5 is connected to the gates of transistors M3 and M4.

In FIG. 3, bipolar transistors Q1 and Q2 are connected as in FIG. 1 with their collectors and bases coupled to the ground reference voltage. With respect to the emitter of transistor Q1, it is connected to the supply reference voltage Vdd through the series-connected source-drain circuits of MOS transistors M1, M1*a*, M3*a* and M3 (where M1/M1*a* are n-channel devices and M3*a*/M3 are p-channel devices). The gate of transistor M1 is connected to the drains of transistors M1*a* and M3*a*. The gate of transistor M1*a* receives a bias voltage Vb2, and the gate of transistor M3*a* receives a bias voltage Vb1. With respect to the emitter of transistor Q2, it is connected to the supply reference voltage Vdd through the series-connected source-drain circuits of MOS transistors M2, M2*a*, M4*a* and M4 (where M2/M2*a* are n-channel devices and M4*a*/M4 are p-channel devices) and series connected resistor R1. The resistor R1 is coupled between the emitter of transistor Q2 and the source of transistor M2. The gate of transistor M4 is connected to the drains of transistor M2*a* and M4*a*. Additionally, the gate of transistor M4 is connected to the gate of transistor M3, while the gate of transistor M2 is connected to the gate of transistor M1. The gate of transistor M2*a* also receives the bias voltage Vb2, and the gate of transistor M4*a* also receives the bias voltage Vb1. A third bipolar transistor Q3 is provided with its collector and base coupled to the ground reference voltage. With respect to the emitter of transistor Q3, it is connected to the supply reference voltage Vdd through the series-connected source-drain circuits of p-channel MOS transistors M5 and M5*a* and resistor R2. The resistor R2 is coupled between the emitter of transistor Q3 and the drain of transistor M5*a*, with the bandgap output voltage Vbg being taken at the drain of transistor M5*a*. The gate of transistor M5*a* also receives the bias voltage Vb1. The gate of transistor M5 is connected to the gates of transistors M3 and M4.

The bandgap voltage Vbg is (equation 1):

$$Vbg = Vbe3 + \frac{R2}{R1} V_T \ln N$$

wherein N is the aspect ratio of Q2 and Q1.

The effective PSRR is expressed as (equation 2):

$$PSRR = \frac{\Delta Vin}{\Delta Vbg} = \frac{Z_{gnd} + Z_{in}}{Z_{gnd}}$$

wherein ΔVbg and ΔVin refer to changes in the bandgap reference voltage and the input supply voltage Vdd, respectively, while $Z_{gnd}$ and $Z_{in}$ represent the effective impedance from the reference to the ground node and to the input supply voltage, respectively.

Obviously, $Z_{in}$ is only $r_{o5}$ and not large enough to achieve high PSRR in FIG. 2. The PSRR is largely improved in FIG. 3 since the cascode is being used to increase the impedance from the reference voltage to the input supply. In this case, it is noted (equation 3):

$$Z_{in} \approx g_{m5a} r_{o5} r_{o5a}$$

Other techniques to improve PSRR for OPAMP-less bandgap, such as a regulated cascade technique, also can be adopted, but it is difficult to realize. Even though the PSRR is high for the techniques of FIGS. 2 and 3, it is not high enough for use in a data converter or other high performance application.

In summary, a number of drawbacks have been noted with respect to the traditional bandgap circuit designs for use in data converter and other high performance circuits: 1) the requirements for the OPAMP (see, FIG. 1) are high for an OPAMP bandgap circuit and the dissipation area is increased; and 2) the PSRR is not high enough for OPAMP-less bandgap designs. Even high PSRR OPAMP-less bandgap circuits have drawbacks since their minimum supply voltage is too high and the circuits are not compatible with the standard CMOS process.

A need accordingly exists for a bandgap circuit which overcomes the foregoing drawbacks and is compatible with the standard CMOS process. The circuit should possess high PSRR and a low temperature coefficient. The circuit should preferably be OPAMP-less so as to minimize dissipation. The circuit should also be compatible with low supply voltages.

SUMMARY OF THE INVENTION

In an embodiment, a circuit comprises an OPAMP-less bandgap voltage generating core circuit connected between a regulated voltage and a ground reference and generating an output bandgap voltage, and a circuit generating the regulated voltage from a supply voltage.

In an aspect, the circuit generating the regulated voltage includes a negative feedback loop operable to stabilize the regulated voltage.

In an aspect, the circuit generating the regulated voltage includes a current supply circuit connected to a node where the regulated voltage is supplied, the current supply circuit including a current mirror operable to mirror a PTAT current of the OPAMP-less bandgap voltage generating core circuit.

In an embodiment, a circuit comprises an OPAMP-less bandgap voltage generating core circuit connected between a regulated voltage node and a ground reference node and generating an output bandgap voltage. The core circuit comprises first and second bipolar transistors connected with their collectors and bases coupled to each other and to the ground reference node, a first resistor having a first end connected to an emitter of the second bipolar transistor and having a second end, a first MOS transistor having a source connected to an emitter of the first bipolar transistor, and a second MOS transistor having a source connected to the second end of the first resistor. The circuit further comprises a circuit generating a regulated voltage at the regulated voltage node from a supply voltage, and a third MOS transistor having its gate connected to a drain of the second MOS transistor and its drain connected to the regulated voltage node.

In an embodiment, a circuit comprises an OPAMP-less bandgap voltage generating core circuit connected between a regulated voltage node and a ground reference node and generating an output bandgap voltage. The core circuit comprises first and second bipolar transistors connected with their collectors and bases coupled to each other and to the ground reference node, a first resistor having a first end connected to an emitter of the second bipolar transistor and having a second end, a first MOS transistor having a source connected to an emitter of the first bipolar transistor, and a second MOS transistor having a source connected to the second end of the first resistor. The circuit further comprises a circuit generating a regulated voltage at the regulated voltage node from a supply voltage, comprising a current source coupled to source current to the regulated voltage node which mirrors a PTAT current of the OPAMP-less bandgap voltage generating core circuit.

BRIEF DESCRIPTION OF THE DRAWINGS

A more complete understanding of the method and apparatus of the present invention may be acquired by reference to the following Detailed Description when taken in conjunction with the accompanying Drawings wherein.

DETAILED DESCRIPTION OF THE DRAWINGS

Figure 1:
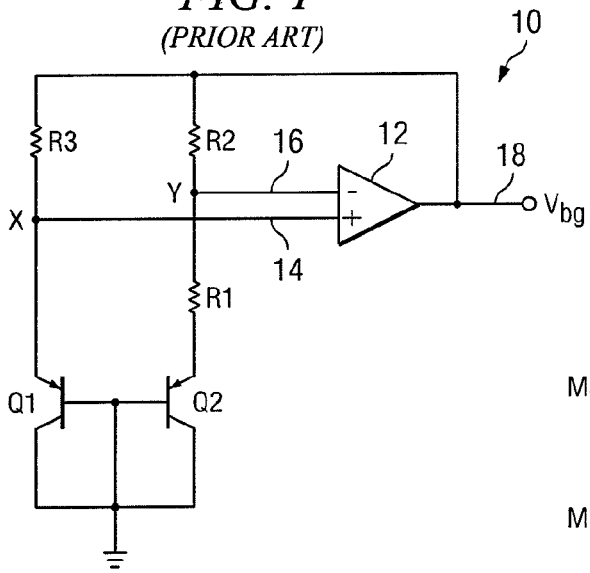
FIG. 1 (PRIOR ART)
FIG. 1 is a circuit diagram of a classical implementation of a bandgap voltage reference generator using an OPAMP.
Figure 2:
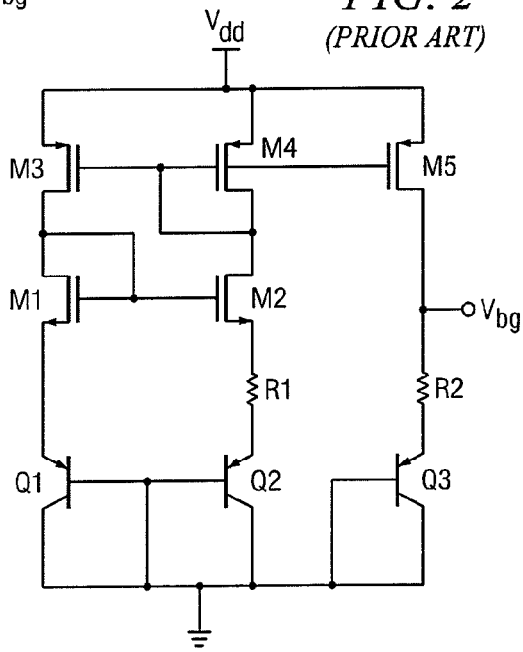
FIG. 2 (PRIOR ART)
FIGS. 2 and 3 illustrate, respectively, a simple and a cascode OPAMP-less bandgap voltage reference generator circuit known in the prior art.
Figure 3:
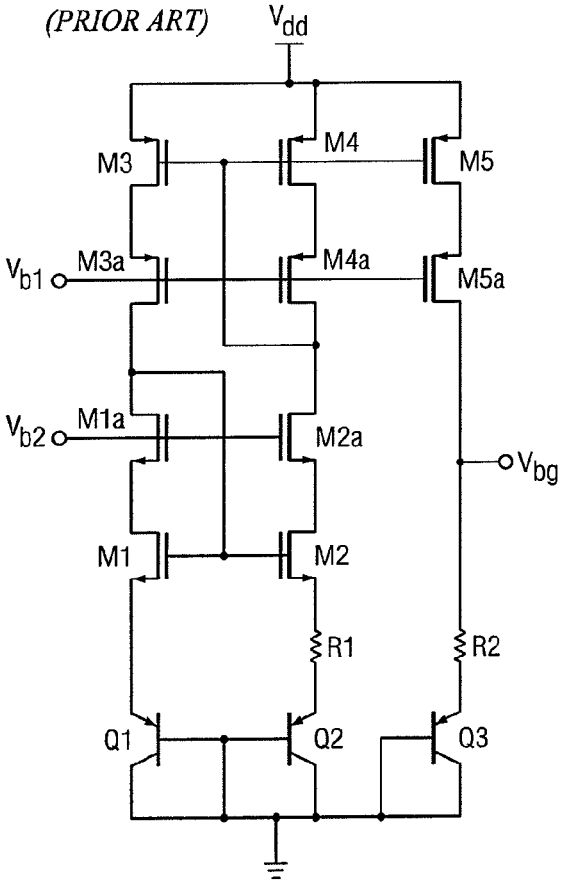
FIG. 3 (PRIOR ART)
Figure 4:
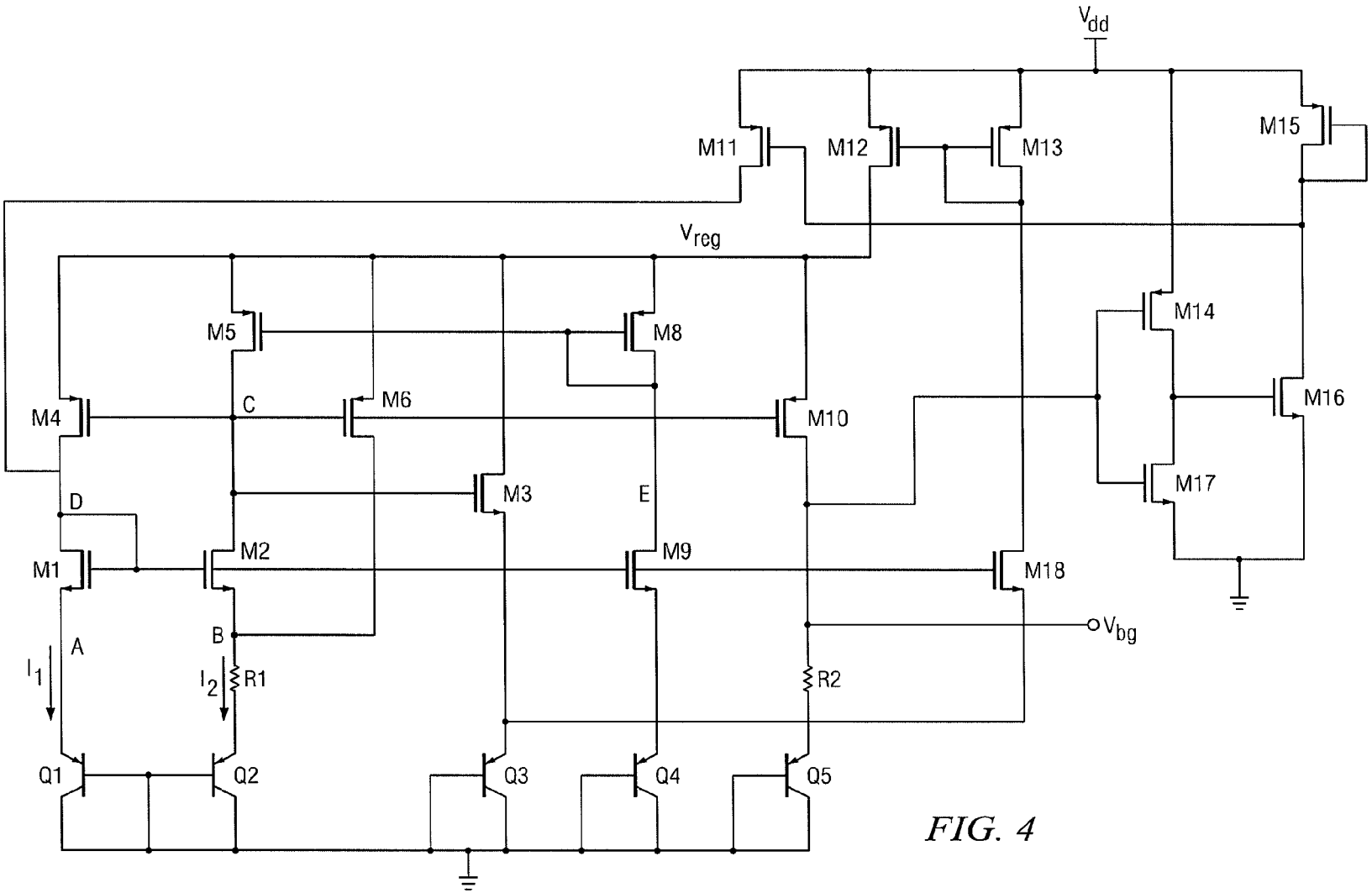
FIG. 4 is a circuit diagram for an OPAMP-less band-gap reference voltage generator circuit in accordance with an embodiment of the present invention.

Reference is now made to FIG. 4 wherein there is shown a circuit diagram for an OPAMP-less band-gap reference voltage generator circuit in accordance with an embodiment of the present invention. Bipolar transistors Q1 and Q2 are connected as in FIG. 1 with their collectors and bases coupled to a ground reference voltage. With respect to the emitter of transistor Q1, it is connected to a regulated voltage Vreg through the series-connected source-drain circuits of MOS transistors M1 and M4 (where M1 is an n-channel device and M4 is a p-channel device). The gate of transistor M1 is connected to the drain of transistor M1. With respect to the emitter of transistor Q2, it is connected to the regulated voltage Vreg through the series-connected source-drain circuits of MOS transistors M2 and M5 (where M2 is an n-channel device and M5 is a p-channel device) and series connected resistor R1. The resistor R1 is coupled between the emitter of transistor Q2 and the source of transistor M2. The gate of transistor M4 is connected to the drain of transistors M2 and M5.

MOS transistor M6 is a p-channel device with its source connected to the regulated voltage Vreg and its drain connected to the source of transistor M2. The gate of transistor M6 is connected to the gate of transistor M4 and the drains of transistors M2 and M5.

A third bipolar transistor Q3 is provided with its collector and base coupled to the ground reference voltage. With respect to the emitter of transistor Q3, it is connected to the regulated voltage Vreg through the series-connected source-drain circuit of n-channel MOS transistor M3. The gate of transistor M3 is connected to the gates of transistors M4 and M6 and to the drains of transistors M2 and M5.

A fourth bipolar transistor Q4 is provided with its collector and base coupled to the ground reference voltage. With respect to the emitter of transistor Q4, it is connected to the regulated voltage Vreg through the series-connected source-drain circuits of p-channel MOS transistor M8 and n-channel MOS transistor M9. The gate of transistor M8 is connected to the drain of transistor M8 and also to the gate of transistor M5. The gate of transistor M9 is connected to the gates of transistors M1 and M2.

A fifth bipolar transistor Q5 is provided with its collector and base coupled to the ground reference voltage. With respect to the emitter of transistor Q5, it is connected to the regulated voltage Vreg through the series-connected source-drain circuit of p-channel MOS transistor M10 and resistor R2. The resistor R2 is coupled between the emitter of transistor Q5 and the drain of transistor M10, with the bandgap output voltage Vbg being taken at the drain of transistor M10. The gate of transistor M10 is connected to the gates of transistors M3 and M4.

A p-channel MOS transistor M11 has its drain connected to the drains of transistors M1 and M4, and its source connected to a supply reference voltage Vdd (which is unregulated and subject to noise, such as switching noise). A p-channel MOS transistor M12 has its source connected to the supply reference voltage Vdd, and provides the regulated voltage Vreg from its drain. A p-channel MOS transistor M13 has its source connected to the supply reference voltage Vdd, and its gate connected to its drain and to the gate of transistor M12. An n-channel MOS transistor M18 has its drain connected to the drain and gate of transistor M13, and its source connected to the emitter of transistor Q3 and source of transistor M3. The gate of transistor M18 is connected to the gates of transistors M1, M2 and M9.

An inverter is formed from MOS transistors M14 (p-channel) and M17 (n-channel). The gates of transistors M14 and M17 are connected to the drain of transistor M10 (at the Vbg output). The source of transistor M14 is connected to the supply reference voltage Vdd, and the source of transistor M17 is connected to the ground reference. A p-channel MOS transistor 15 has its source connected to the supply reference voltage Vdd, and its drain connected to its gate as well as to the gate of transistor M11. A n-channel MOS transistor M16 has its drain connected to the drain of transistor M15 and its source connected to the ground reference. The gate of transistor M16 is connected to the drains of transistors M14 and M17.

The circuit of FIG. 4 provides high PSRR over a relatively broad frequency range in order to reject noise from any other high speed digital circuits which may also be implemented in the same integrated circuit chip. It will be noted that the circuit advantageously does not utilize an OPAMP. The circuit is operable with a low supply voltage and with low power dissipation.

The circuit operates from an internal pre-regulated supply voltage Vreg in order to improve PSRR. The core of the bandgap circuit comprises two feedback loops for providing equality of voltage at nodes A and B. One loop is a positive feedback loop that includes transistors M1, M2 and M4. Another loop is a negative feedback loop that includes transistors M1, M4, M5, M8 and M9. The voltage Vreg is stabilized by a main negative loop which includes transistors M3 and M5. The current for Vreg is supplied by transistor M12 which mirrors the PTAT current through transistor M18. The circuit includes a start-up circuit that is composed of transistors M11, M14, M15, M16 and M17.

The circuit operates as follows:

Feedback loops for equality of voltage at nodes A and B. If the gain of the negative feedback loop is larger than the gain of the positive feedback loop, then equality of voltage at nodes A and B can be achieved. If S represents the aspect ratio of a transistor (with the subscript numbers identifying the MOS transistor of interest), then in stable condition $V_A=V_B$, $S_1:S_2:S_9=2:1:2$, $I_1:I_2:I_9=2:1:2$, $S_4:S_5:S_8=2:1:2$. So, $g_{m1}=g_{m9}=2_{gm2}$. If $V_A>V_B$, then the effective $V_{GS}$ of $M_1$, $M_2$ and $M_9$ is increasing and the negative feedback will cause it to be stabilized. The positive loop gain is (equation 4):

$$Av(+) = \frac{g_{m2}}{1 + g_{m2}(R_1 + r_{eb2})} r_C g_{m4} r_D$$

wherein $r_C$ is the resistance at node C, $r_D$ is the resistance at node D, and $r_{eb2}$ is the total emitter resistance of transistor Q2. The negative loop gain is (equation 5):

$$Av(-) = \frac{g_{m9}}{1 + g_{m9} r_{eb4}} \left( \frac{1}{g_{m8}} \| r_{o9} \right) g_{m5} r_C g_{m4} r_D$$

wherein $r_{o9}$ is the resistance seen into the drain of M9, $r_{eb3}$ is the emitter resistance of Q3. Because $1/g_{m8} \ll r_{o9}$ and $g_{m9}=2g_{m2}$, and $A_8:A_5=2:1$, then $g_{m8}=2g_{m5}$, thus (equation 6):

$$Av(-) = \frac{1}{2g_{m5}} \frac{2g_{m2}}{1 + g_{m2} r_{eb4}} g_{m5} r_C g_{m4} r_D = \frac{g_{m2}}{1 + g_{m2} r_{eb4}} r_C g_{m4} r_D$$

For common-base configuration, the emitter resistance (equation 7):

$$r'_{eb} = \frac{\alpha_o}{g_m} \approx \frac{\alpha_o}{I'_E} V_T$$

wherein $I_E'$ is the emitter current of the bipolar transistor Q4 through node E. Now $I_1=I_{c4}=I_E$, so the parallel resistance of Q2 is (equation 8):

$$r_{eb2} = N \frac{\alpha_o}{I_E / N} V_T = r_{eb4}$$

wherein N is the area ratio of Q2 to Q1. Comparing equations (2) and (6), one can obtain (equation 9): Av(−)>Av(+) so the voltage at node A will be equal to the voltage at node B.

Feedback to stabilize the voltage of Vreg. The voltage variation at Vreg is sensed by transistor M4 and a current variation is produced. However, the effective transconductance of transistor M2 is smaller than that of transistor M9. So, the current of transistor M5 is not the same as the current of transistor M2 and $V_C$ is changed synchronously with Vreg. Thus, $V_C$ is sensed by transistor M3 and fed back to Vreg to stabilize the Vreg voltage.

Assume an incremental variation vreg, $v_C$ and $v_E$ for the voltages Vreg, $V_C$ and $V_E$, respectively. So, the incremental currents in transistors M4 and M8 are (equations 9 and 10):

$$i_{m4}=g_{m4}(\text{vreg}-v_C) \text{ and } i_{m8}=g_{m8}(\text{vreg}-v_E)$$

Taking into account the current mirror relationships, one can obtain (equation 11):

$$i_{m8}=i_{m4}$$

Thus (equation 12):

$$v_C = \frac{g_{m4}-g_{m8}}{g_{m4}} vreg + \frac{g_{m8}}{g_{m4}} v_E$$

and (equation 13):

$$v_E = \frac{r_{o9}}{r_{o9}+1/g_{m4}} vreg = \frac{g_{m8}r_{o9}}{1+g_{m4}r_{o9}} vreg$$

Substituting equation (13) into equation (12) gives (equation 14):

$$v_C = \frac{(g_{m4}-g_{m8})+g_{m4}g_{m8}r_{o9}}{g_{m4}(1+g_{m8}r_{o9})} vreg$$

The incremental change $v_C$ causes a reduction in the voltage vreg. Thus, the negative feedback forces Vreg to stabilize. The loop gain can be approximately written as (equation 15):

$$A = -\frac{i_3 r_{reg}}{vreg} = -\frac{g_{m3}v_C r_{reg}}{vreg} = -g_{m3}r_{reg}\frac{(g_{m4}-g_{m8})+g_{m4}g_{m8}r_{o9}}{g_{m4}(1+g_{m8}r_{o9})}$$

wherein $r_{reg}$ is the resistance seen at the node Vreg.

Transistors M12, M13 and M18 mirror the PTAT current and provide the current for Vreg as needed. The bandgap voltage is written as (equation 16):

$$Vbg = V_{be5} + \frac{R_2}{R_1} V_T \ln N$$

There are other contributions to stabilize Vreg such as the loop through transistors M4, M1, M18, M13 and M12. In fact, when Vdd is low, such as less than a value $V_{DDmin}$ (to be described), then the transistor M3 does not operate and the function to stabilize the voltage Vreg mainly depends on the loop through transistors M4, M1, M18, M13 and M12 rather than the loop through transistor M3.

The circuit has a low voltage structure. The minimum power supply for the circuit is (equation 17):

$$V_{DDmin}=V_{eb3}+V_{GS3}+V_{GS6}+V_{OV12}=V_{eb3}+V_{OV3}+V_{OV6}+V_{OV12}+V_{TN}+V_{TP}$$

Assuming that $V_{eb3}$=0.75V, $V_{TN}$=0.63V, $V_{TP}$=0.52V, then assume $V_{OV3}=V_{OV6}=V_{OV12}$=0.2V, so then $V_{DDmin}$=2.5V. In FIG. 4, the source of transistor M3 cannot be connected to ground because the minimum voltage of node C is (equation 18):

$$V_{Cmin}=V_{eb1}+V_{GS1}+V_{GD4}=V_{eb1}+V_{TN}+V_{OV1}-V_{TP}\approx 1.1V$$

However, if the source of transistor M3 is connected to ground, then the voltage of node C will be clamped to (equation 19):

$$V_C=V_{GS3}\approx 0.9V$$

Therefore, the bandgap core cannot work effectively. However, it will be noted that the circuit can still work when Vdd is lower than $V_{DDmin}$ because even when the transistor M3 is not operational the loop through transistors M4, M1, M18, M13 and M12 can regulate the voltage of Vreg. Unfortunately, in this mode, the PSRR will drop significantly.

There are several factors to be considered with respect to the low voltage structure: (1) a lower voltage bandgap with high PSRR can be achieved through use of a lower threshold device, and (2) to obtain a high PSRR with wide bandwidth, the aspect ratio of transistor M3 must be appropriate.

A high PSRR mechanism. It is difficult to obtain high PSRR without using an OPAMP. So, in using an OPAMP-less circuit, the use of a preregulator circuit of FIG. 4 with respect to the supply voltage for the bandgap core circuit is a good choice. Normally, a preregulator circuit consists of several diodes or is a zener diode. However, these solutions are not suitable for use with CMOS technology for two reasons: (1) floating diodes are not available in CMOS, and (2) the temperature coefficient of the diode preregulator is too high. The circuit of FIG. 4 adopts a new preregulator circuit which reuses the bandgap core with negative feedback to stabilize the voltage of the regulator as described above. The source current for the preregulator comes from a PTAT current.

Assume vin, vreg and vo are the AC parts of the voltages Vdd, Vreg and Vbg, respectively. Further assume that $i_{reg}$ and $i_{m10}$ are the AC parts of the current of node Vreg and transistor M10. Then (equation 20):

$$PSRR = \frac{vin}{vo} = \frac{r_{o12}+r_{reg}}{r_{reg}} \frac{vreg}{i_{m10}} \frac{i_{m10}}{v_o}$$

wherein $r_{o12}$ and $r_{reg}$ are the resistance of transistor M12 seen from the node Vreg to Vdd and the resistance of node Vreg seen down to the ground. The variation of Vreg leads to (equations 21-24):

$$i_{m5} = g_{m5}(vreg - v_E),$$

$$i_{m8} = \frac{g_{m9}}{g_{m1}} i_{m4} = i_{m4}$$

$$i_{m3} = g_{m3}v_C,$$

$$i_{m4} = g_{m4}(vreg - v_C),$$

$$i_{m6} = g_{m6}(vreg - v_C)$$

$$i_{m10} = g_{m10}(vreg - v_C)$$

$$i_{reg} = i_{m3} + i_{m4} + i_{m5} + i_{m6} + i_{m8} + i_{m10}$$

Substituting equations (13) and (14) into equations (21)-(24) gives (equations 25-27):

$$r_{reg} = \frac{g_{m4}(1 + g_{m8}r_{o9})}{g_{m3}g_{m4}g_{m8}r_{o9} + g_{m4}(g_{m4} + g_{m6} + g_{m8} + g_{m10}) + g_{m5}g_{m8}}$$

$$i_{m10} = \frac{g_{m8}}{1 + g_{m8}r_{o9}} vreg$$

$$\frac{i_{m10}}{vo} = \frac{1}{R_2}$$

Substituting equations (25)-(27) into equation (20) gives (equation 28):

$$PSRR = \frac{g_{m4}(1 + g_{m8}r_{o9}) + r_{o12}\left(\begin{array}{c} g_{m3}g_{m4}g_{m8}r_{o9} + \\ g_{m4}(g_{m4} + g_{m6} + g_{m8} + g_{m10}) + \\ g_{m5}g_{m8} \end{array}\right)}{g_{m4}g_{m10}R_2}$$

This equation shows the parameters of importance to increase PSRR. Wideband and high PSRR may be achieved by applying the following: (1) transistor M3 is used to stabilize Vreg by amplifying the voltage $V_C$ so as to improve PSRR; (2) the gate of transistor M10 connecting to $V_C$ assists in improving PSRR because Vreg and $V_C$ vary in the same direction and this leads to a weakening of the current variation of transistor M10; (3) the bandgap core is supplied by a regulated voltage designed with several negative feedback loops; and (4) the wideband PSRR is achieved using an OPAMP-less implementation and by reducing the resistance of the first pole.

Low temperature coefficient mechanism. If the preregulator was composed of a simple diode structure, then its temperature coefficient (TC) would be unacceptable. In order to improve the TC of the bandgap output voltage Vbg, the TC of the preregulator must be low. In the circuit of FIG. 4, PTAT current is fed back to the preregulator to give a positive temperature coefficient contribution.

The voltage Vreg can be expressed as (equation 29):

$$\begin{aligned} Vreg &= V_{eb3} + V_{GS3} + V_{GS6} \\ &= V_{eb3} + V_{OV3} + V_{OV6} + V_{TN} + V_{TP} \end{aligned}$$

$$Vreg = V_{eb3} + V_{TN} + V_{TP} + \sqrt{\frac{2I_3}{K_N S_3}} + \sqrt{\frac{2I_6}{K_P S_6}}$$

wherein S represents the aspect ratio of the transistor of interest identified by the subscript and $K_N$ and $K_P$ are the transconductance parameters of n- and p-channel MOS transistors. Thus, the temperature coefficient of Vreg is (equation 30):

$$\frac{dVreg}{dT} = \frac{dV_{eb3}}{dT} + 2\frac{dV_T}{dT} + \frac{1}{\sqrt{2K_N I_3 S_3}}\frac{dI_3}{dT} + \frac{1}{\sqrt{2K_P I_6 S_6}}\frac{dI_6}{dT}$$

Because $I_3=I_6=InN/2R_1$, then equation (30) becomes (equation 31):

$$\frac{dVreg}{dT} = \frac{dV_{eb3}}{dT} + \frac{dV_T}{dT}\left(2 + \left(\frac{1}{2\sqrt{2K_N I_3 S_3}} + \frac{1}{2\sqrt{2K_P I_6 S_6}}\right)\frac{\ln N}{R_1}\right)$$

Let dVreg/dT=0; and thus (equation 32):

$$\frac{1}{2\sqrt{2K_N I_3 S_3}} + \frac{1}{2\sqrt{2K_N I_6 S_6}}\frac{\ln N}{R_1} = 15.4$$

wherein $dV_{eb3}/dT=-1.5$ mV/° C., and $dV_T/dT=0.086$ mV/° C.

To achieve other better characteristics to suit the application, the parameters of the transistors must be chosen to get low temperature coefficients other than a zero temperature coefficient. For example, N=8, $K_N=80\ \mu A/V^2$, $K_P=40\ \mu A/V^2$, $I_3=I_6=5\ \mu A$, $S_3=2$, $S_6=3$, and R1=5.4KΩ. Then, dVreg/dT=−0.55 mV/° C.

Figure 5:
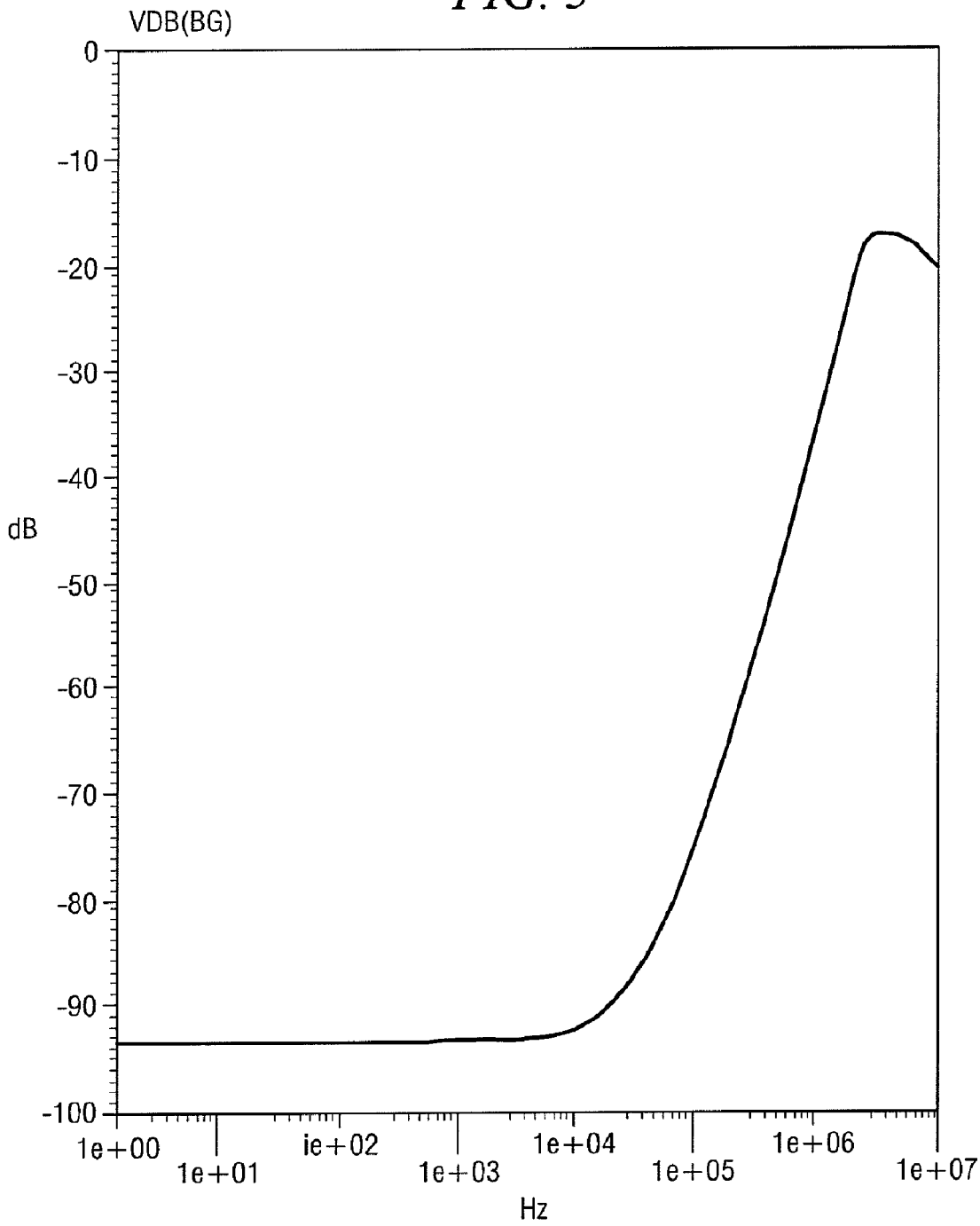
FIG. 5 illustrates a simulation of PSRR for the circuit of FIG. 4.
Figure 6:
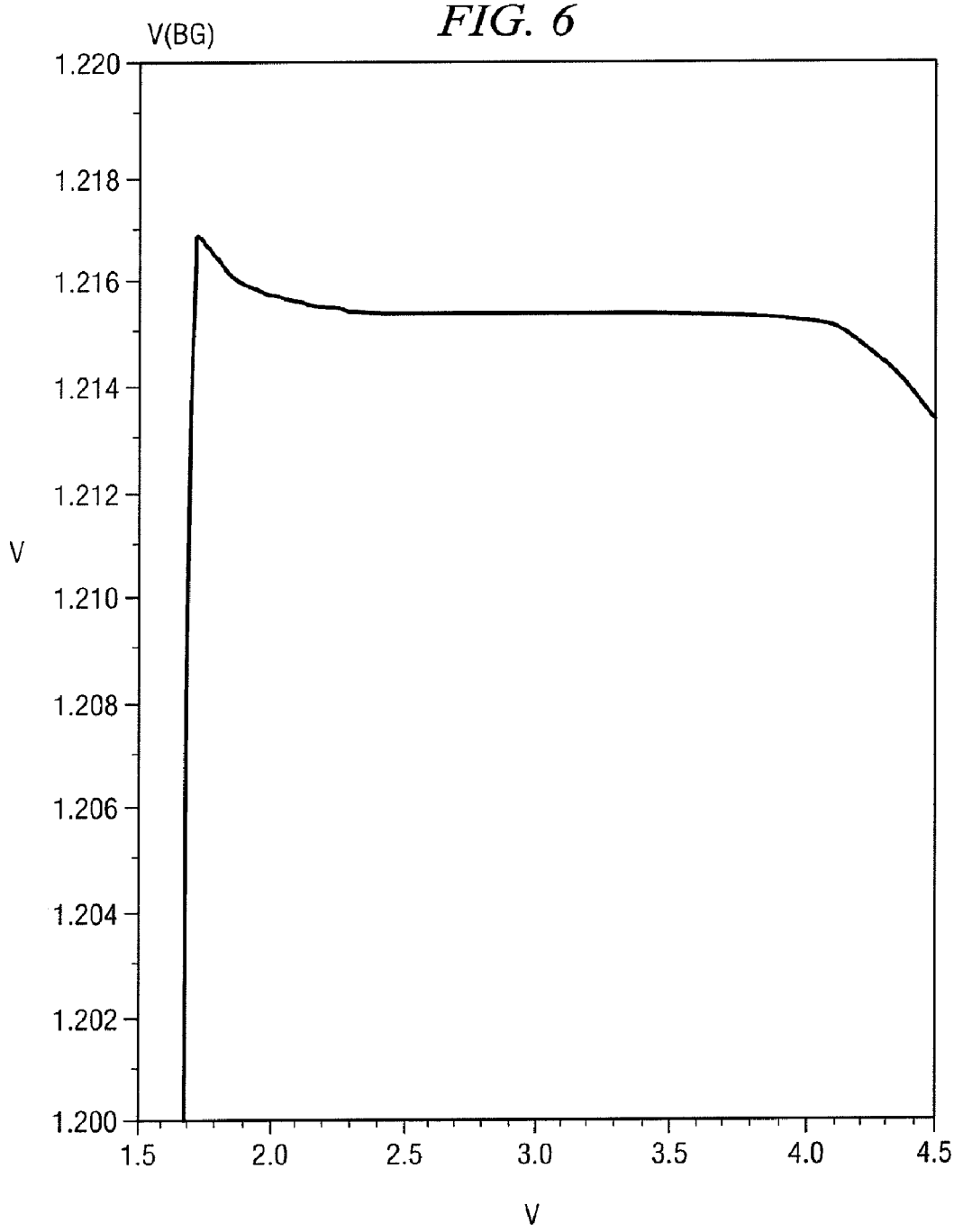
FIG. 6 illustrates a simulation of line regulation for the circuit of FIG. 4.
Figure 7:
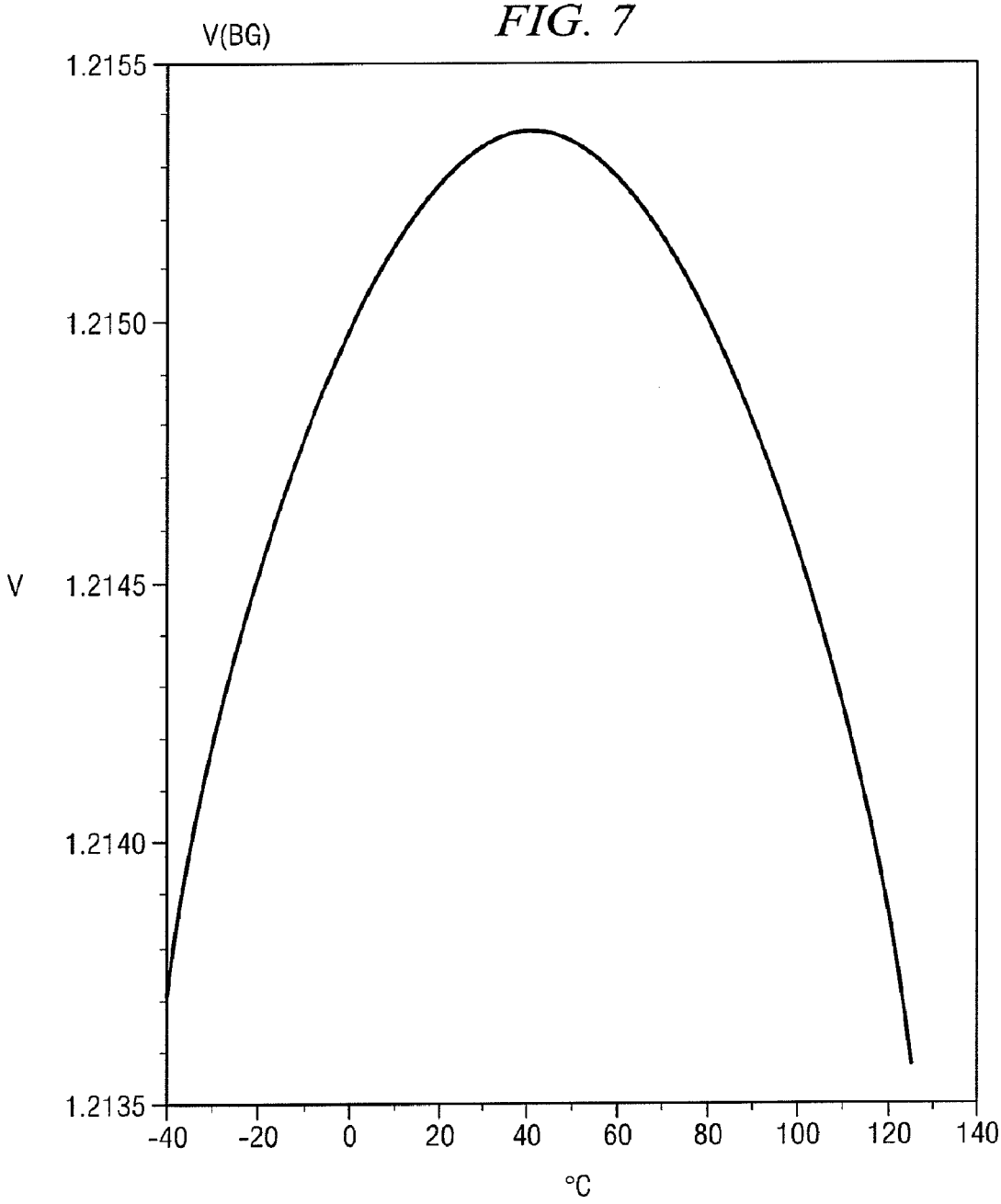
FIG. 7 illustrates a simulation of temperature coefficient for the circuit of FIG. 4.
Figure 8:
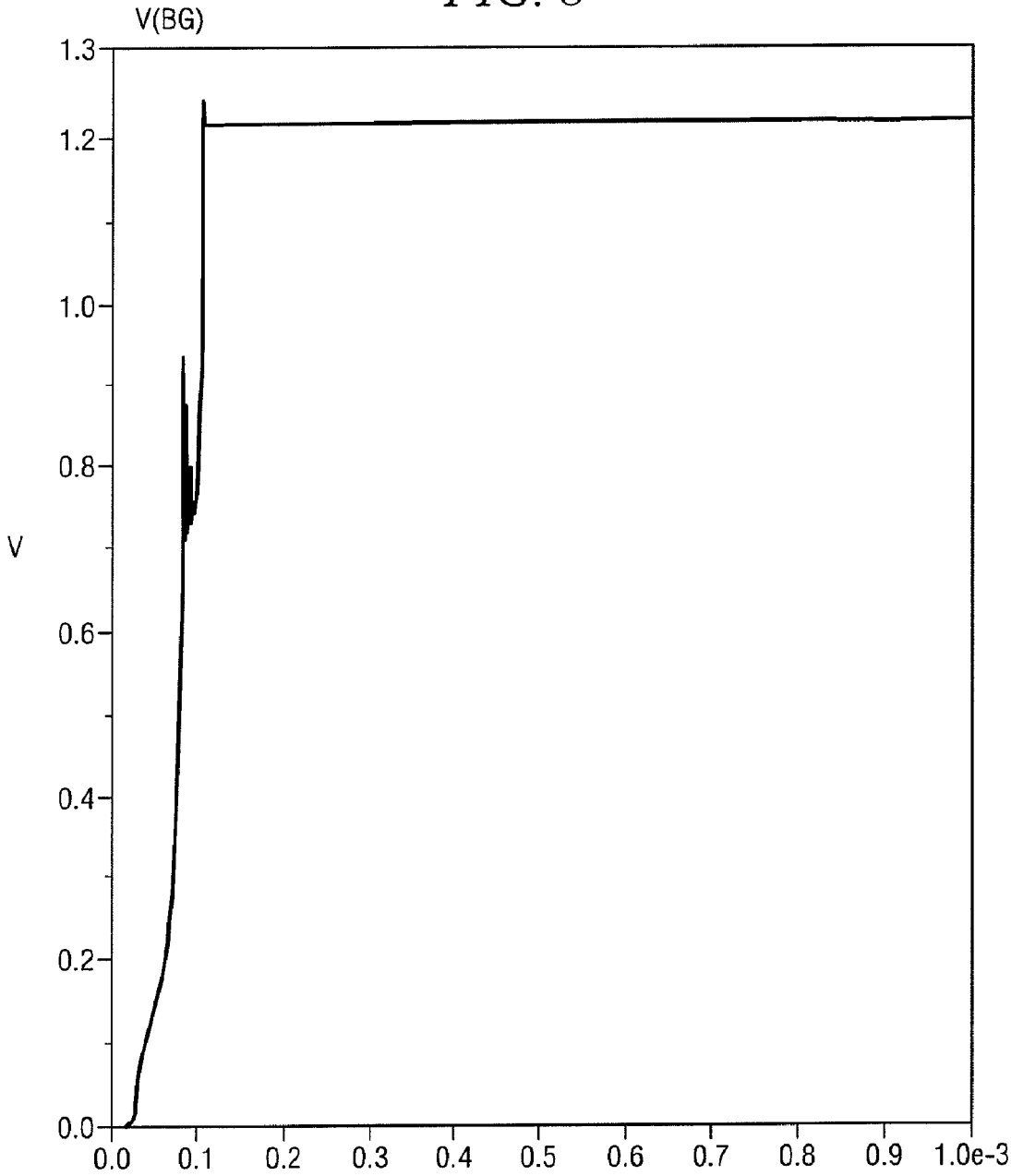
FIG. 8 illustrates a simulation of transient for the circuit of FIG. 4.

The circuit of FIG. 4 was simulated with a 3V power supply voltage Vdd, and MOS devices having $V_{TN}=0.63V$ and $V_{TP}=0.52V$. FIG. 5 illustrates the simulation results for PSRR showing the circuit capable of a PSRR for Vbg of −93 db at 10 KHz, −75 dB at 100 KHz and −35 db at 1 MHz. FIG. 6 illustrates the simulation results for line regulation (with performance of 1 mV/V for Vdd from 2V to 4V, and 0.3 to 0.6 mV/V for Vdd from 2V to 3.5 V). FIG. 7 illustrates the simulation results for the temperature coefficient of 9 ppm/° C. FIG. 8 illustrates the simulation results for transients.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A circuit, comprising:

an OPAMP-less bandgap voltage generating core circuit connected between a regulated voltage and a ground reference and generating an output bandgap voltage; and a regulating circuit generating the regulated voltage from an unregulated supply voltage;

wherein the OPAMP-less bandgap voltage generating core circuit includes a first and second node and further including a negative feedback loop and a positive feedback loop, the negative and positive feedback loops functioning to equalize the voltage at the first and second nodes.

2. The circuit of claim 1 wherein the OPAMP-less bandgap voltage generating core circuit includes first and second bipolar transistors with their collectors and bases coupled to each other and a first resistor having a first end connected to an emitter of the second bipolar transistor and having a second end, the first and second nodes being the second end of the first resistor and an emitter of the first bipolar transistor.

3. The circuit of claim 1 wherein a gain of the negative feedback loop is larger than a gain of the positive feedback loop.

4. The circuit of claim 1 wherein the regulating circuit generating the regulated voltage includes a main negative feedback loop operable to stabilize the regulated voltage.

5. The circuit of claim 4 wherein the main negative feedback loop operable to stabilize the regulated voltage is coupled to sense an internal voltage within the OPAMP-less bandgap voltage generating core circuit which tracks the regulated voltage.

6. The circuit of claim 1 wherein the regulating circuit generating the regulated voltage includes a current supply circuit connected to a node where the regulated voltage is supplied, the current supply circuit including a current mirror operable to mirror a PTAT current of the OPAMP-less bandgap voltage generating core circuit.

7. The circuit of claim 1 wherein the regulating circuit generating the regulated voltage includes a sensing circuit for sensing a voltage which varies with variations in the regulated voltage and feeds back to the regulated voltage in order to stabilize the regulated voltage.

8. The circuit of claim 7 wherein the sensed voltage which varies is an internal voltage within the OPAMP-less bandgap voltage generating core circuit.

9. A circuit, comprising:

an OPAMP-less bandgap voltage generating core circuit connected between a regulated voltage node and a ground reference node and generating an output bandgap voltage, the core circuit comprising:

first and second bipolar transistors connected with their collectors and bases coupled to each other and to the ground reference node;

a first resistor having a first end connected to an emitter of the second bipolar transistor and having a second end;

a first MOS transistor having a source connected to an emitter of the first bipolar transistor; and a second MOS transistor having a source connected to the second end of the first resistor; and a regulating circuit generating a regulated voltage at the regulated voltage node from an unregulated supply voltage including a third MOS transistor having its gate connected to a drain of the second MOS transistor and its drain connected to the regulated voltage node;

wherein the regulating circuit generating the regulated voltage comprises:

a fourth MOS transistor coupled to the unregulated supply voltage and which sources current to the regulated voltage node;

a fifth MOS transistor coupled to the unregulated supply voltage and having its gate connected to its drain and to a gate of the fourth MOS transistor; and a sixth MOS transistor having a drain connected to a drain of the fifth MOS transistor and having a gate connected to the gates of the first and second MOS transistors.

10. The circuit of claim 9 further comprising a third bipolar transistor whose collector and base are coupled to each other and to the ground reference node and whose emitter is connected to a source of the third MOS transistor.

11. The circuit of claim 9 further comprising a current source coupled to source current to the regulated voltage node.

12. The circuit of claim 11 wherein the current sourced to the regulated voltage node is a current which mirrors a PTAT current of the OPAMP-less bandgap voltage generating core circuit.

13. The circuit of claim 9 wherein a source of the sixth MOS transistor is connected to the source of the third MOS transistor.

14. A circuit comprising:

an OPAMP-less bandgap voltage generating core circuit connected between a regulated voltage node and a ground reference node and generating an output bandgap voltage, the core circuit comprising:

first and second bipolar transistors connected with their collectors and bases coupled to each other and to the ground reference node;

a first resistor having a first end connected to an emitter of the second bipolar transistor and having a second end;

a first MOS transistor having a source connected to an emitter of the first bipolar transistor; and a second MOS transistor having a source connected to the second end of the first resistor; and a regulating circuit generating a regulated voltage at the regulated voltage node from an unregulated supply voltage including a third MOS transistor having its gate connected to a drain of the second MOS transistor and its drain connected to the regulated voltage node;

wherein the OPAMP-less bandgap voltage generating core circuit further includes a negative feedback loop and a positive feedback loop, the negative and positive feedback loops functioning to equalize the voltage at the second end of the first resistor and emitter of the first bipolar transistor.

15. A circuit, comprising:

an OPAMP-less bandgap voltage generating core circuit connected between a regulated voltage node and a ground reference node and generating an output bandgap voltage, the core circuit comprising:

first and second bipolar transistors connected with their collectors and bases coupled to each other and to the ground reference node;

a first resistor having a first end connected to an emitter of the second bipolar transistor and having a second end;

a first MOS transistor having a source connected to an emitter of the first bipolar transistor; and a second MOS transistor having a source connected to the second end of the first resistor; and a regulating circuit generating a regulated voltage at the regulated voltage node from an unregulated supply voltage comprising:

a current source coupled to source a current to the regulated voltage node which mirrors a PTAT current of the OPAMP-less bandgap voltage generating core circuit;

a third MOS transistor connected in a current mirror with the current source; and a fourth MOS transistor having a drain connected to a drain of the third MOS transistor and having a gate connected to the gates of the first and second MOS transistors.

16. A circuit comprising:

an OPAMP-less bandgap voltage generating core circuit connected between a regulated voltage node and a ground reference node and generating an output bandgap voltage, the core circuit comprising:

first and second bipolar transistors connected with their collectors and bases coupled to each other and to the ground reference node;

a first resistor having a first end connected to an emitter of the second bipolar transistor and having a second end;

a first MOS transistor having a source connected to an emitter of the first bipolar transistor; and a second MOS transistor having a source connected to the second end of the first resistor, and a regulating circuit generating a regulated voltage at the regulated voltage node from an unregulated supply voltage comprising a current source coupled to source a current to the regulated voltage node which mirrors a PTAT current of the OPAMP-less bandgap voltage generating core circuit;

wherein the current source is a third MOS transistor coupled to the unregulated supply voltage, the regulating circuit generating a regulated voltage comprising:

a fourth MOS transistor coupled to the unregulated supply voltage and having its gate connected to its drain and to a gate of the third MOS transistor; and a fifth MOS transistor having a drain connected to a drain of the fourth MOS transistor and having a gate connected to the gates of the first and second MOS transistors.

17. The circuit of claim 16 further comprising a sixth MOS transistor having its gate connected to a drain of the second MOS transistor and its drain connected to the regulated voltage node.

18. The circuit of claim 17 further comprising a third bipolar transistor whose collector and base are coupled to each other and to the ground reference node and whose emitter is connected to a source of the sixth MOS transistor.

19. The circuit of claim 17 wherein a source of the fifth MOS transistor is connected to the source of the sixth MOS transistor.

20. A circuit comprising:

an OPAMP-less bandgap voltage generating core circuit connected between a regulated voltage node and a ground reference node and generating an output bandgap voltage, the core circuit comprising:

first and second bipolar transistors connected with their collectors and bases coupled to each other and to the ground reference node;

a first resistor having a first end connected to an emitter of the second bipolar transistor and having a second end;

a first MOS transistor having a source connected to an emitter of the first bipolar transistor; and a second MOS transistor having a source connected to the second end of the first resistor, and a regulating circuit generating a regulated voltage at the regulated voltage node from an unregulated supply voltage comprising a current source coupled to source a current to the regulated voltage node which mirrors a PTAT current of the OPAMP-less bandgap voltage generating core circuit;

wherein the OPAMP-less bandgap voltage generating core circuit further includes a negative feedback loop and a positive feedback loop, the negative and positive feedback loops functioning to equalize the voltage at the second end of the first resistor and emitter of the first bipolar transistor.

* * * * *